US006903333B2

(12) United States Patent
West et al.

(10) Patent No.: US 6,903,333 B2
(45) Date of Patent: Jun. 7, 2005

(54) MASS SPECTROMETER

(75) Inventors: Marc B. A. West, Galston (AU); Fangtong Zhang, Burwood (AU); Ondrej Votava, Praque (CZ); Scott H. Kable, Chippendale (AU)

(73) Assignee: The University of Sydney, Sydney (AU)

( * ) Notice: Subject to any disclaimer, the term of this patent is extended or adjusted under 35 U.S.C. 154(b) by 63 days.

(21) Appl. No.: 10/476,052

(22) PCT Filed: May 3, 2002

(86) PCT No.: PCT/AU02/00550

§ 371 (c)(1),
(2), (4) Date: Oct. 24, 2003

(87) PCT Pub. No.: WO02/091426

PCT Pub. Date: Nov. 14, 2002

(65) Prior Publication Data

US 2004/0245454 A1 Dec. 9, 2004

(30) Foreign Application Priority Data

May 3, 2001 (AU) ..... PR4748

(51) Int. Cl.[7] ..... H01J 49/34
(52) U.S. Cl. ..... 250/288

(58) Field of Search ..... 250/288, 423 R, 250/424, 423 P

(56) References Cited

U.S. PATENT DOCUMENTS 3,611,029 A * 10/1971 Stix ..... 361/230

* cited by examiner

*Primary Examiner*—Kiet T. Nguyen
(74) *Attorney, Agent, or Firm*—Bella Fishman

(57) ABSTRACT

A new mass spectrometer (10) is described in which sample molecules (26) are ionized and caused to oscillate to and fro by reflecting electric fields established between two electrodes (12, 14) in a vacuum chamber (20). A mesh electron producing electrode (16) is located between reflector electodes (12, 14) and produces electrons by secondary emission on each pass of the oscillating ions when some of those ions strike the mesh. The secondary eldctrons are detected (18) after passage through reflector electrode (12), which is alos a mesh. The frequency of oscillation of the ions depends upon their mass and from the frequency distribution of the signals from each electron production event it is possible to identify the ions of different masses. The invention allows for a much more compact spectrometer instrument compared to a Time of flight Mass Spectrometer which is less expensive than a Fourier Transform Mass emplying ion-cyclotron resonance.

20 Claims, 7 Drawing Sheets

MASS SPECTROMETER

TECHNICAL FIELD

The present invention relates to a mass spectrometer and a method for mass spectrometry.

BACKGROUND

Mass spectrometry is one of the simpler spectrometric concepts wherein molecules of a sample are ionised, then the ions are separated generally according to their mass to charge ratio in a mass analyser and then detected. Mass analysers of many types are available, such as magnetic field, combined electric and magnetic field, quadrupole, ion-cyclotron resonance, quadrupole ion storage trap and time of flight analysers. Of these, time of flight mass spectrometry (TOFMS) provides high sensitivity and is able to measure extended (virtually limitless) mass ranges. It is therefore ideally suited to the analysis of bio and synthetic polymers. TOFMS also has an advantage over other methods of mass analysis in that the complete mass spectrum is obtained from every ionization event. However TOFMS instruments are large and require very high vacuum conditions ($10^{-6}$ Torr) because of the length of the field free drift region (about 0.5 to 1 m long) that is required in which ions of different masses are separated. A reflectron (an ion mirror) has been included at the end of the drift region to reflect ions back through the drift region and this has allowed improved mass resolution. However the problems remain that TOFMS instruments are large, very high vacuum instruments.

Another high sensitivity mass analyser that provides excellent resolution is one that uses the ion-cyclotron resonance (ICR) phenomenon, for example as in a Fourier Transform Mass Spectrometer (FTMS). In FTMS, ions are allowed to circulate within an ion trap in defined orbits over extended periods of time. An ac input signal is applied which modifies the ion orbits depending upon mass/charge ratios of the ions. Ions are detected by their generation of an "image current" as they pass an electrode. The time-domain signal that is produced is then Fourier transformed into a frequency domain signal and then into the corresponding mass spectrum. FTMS instruments, however, are expensive.

The discussion herein of the background to the invention is included to explain the context of the invention. This is not to be taken as an admission that any of the matters referred to were part of the common general knowledge in the art in Australia as at the priority date of any of the claims.

An object of the present invention is to provide a mass spectrometer and method therefor having high sensitivity, high resolution and a capability of measuring extended mass ranges, and in which the above described problems of TOFMS and FTMS are reduced.

DISCLOSURE OF THE INVENTION

According to a first aspect the present invention provides a mass spectrometer for measuring the mass of molecules including ionization means for producing ions of the molecules, means for influencing said ions to cause them to oscillate to and fro, whereby the frequency of oscillation of an ion depends upon its mass, an electron producing means disposed in relation to the oscillating ions for some of the oscillating ions to cause the electron producing means to produce electrons at a frequency determined by an oscillation frequency of the ions, and a detector for detecting the electrons and frequency of production thereof from which the mass of ions oscillating at that frequency is calculable.

According to a second aspect, the invention also provides a method for mass spectrometry including (i) ionizing molecules of a sample to produce ions thereof, (ii) Influencing the ions to cause them to oscillate to and fro, whereby the frequency of oscillation of an Ion depends upon its mass, (iii) causing some of the oscillating ions to interact with an electron producing means, whereby electrons are produced at a frequency determined by an oscillation frequency of the ions, (iv) detecting the produced electrons and frequency of production thereof, and (v) from the frequency determination of step (iv), calculating the mass of ions oscillating at that frequency.

The invention relies upon the fact that the frequency of oscillation of the ions depends upon their mass (actually their mass/charge ratio) and the discovery of a "mechanism" for measuring the frequencies of oscillation of ions of different masses that is simpler than the measurement regime in FTMS. This "mechanism" involves producing electrons each time oscillating ions of a particular mass/charge ratio pass a fixed location (which location is defined by the electron producing means) and obtaining a signal (electron "burst") vs time representation. The frequency distribution of the signals from each electron production event in this representation allow identification of the ions of different masses.

Preferably the electron producing means is such that it emits electrons upon collision of an oscillating ion therewith. Thus this means may be an electrode that includes a plurality of apertures through which some of the oscillating ions can pass whilst others of the oscillating ions collide with the electrode. Preferably the electron producing electrode is a relatively fine metal mesh or grid. In one embodiment the metal mesh or grid is such that approximately 15% of the oscillating ions collide therewith for the mesh or grid to emit electrons.

It will be understood that in embodiments as above described the detection "mechanism" involves destruction of some ions each time the ions oscillate past the electron producing electrode. Whilst this is not as ideal as in FTMS (where detection of the orbiting ions does not result in their destruction), it is better than in TOFMS wherein detection of the ions results in their total destruction. Of course, the mesh or grid of the electron producing electrode may have a permeability that is selected to suit requirements, for example, a higher permeability to the oscillating ions will reduce the electrons that are emitted (and thus the signal to be detected) on each pass of the ions but will allow many more passes to be measured and hence better mass resolutions.

An advantage of the invention is that the ions can be influenced to oscillate in close proximity to where they are produced, and the electron producing means is of necessity located in close proximity to the oscillating ions, thus the main components of the spectrometer can be compactly arranged allowing for the development of a quite compact mass spectrometer instrument. Furthermore, the invention requires a vacuum of $10^{-5}$ Torr or lower, which figure is about a factor of ten greater than the highest pressure that is tolerable by a conventional TOFMS. Hence the vacuum system requirements for a mass spectrometer according to the invention are less than those for a TOFMS. Thus the invention reduces the problems of TOFMS.

Preferably the means for influencing the ions to cause them to oscillate to and fro are electrodes (hereinafter termed reflector electrodes) for providing electric fields for reflecting the ions to cause them to so oscillate. Preferably these electrodes for reflecting the ions are a pair of spaced generally parallel electrodes and the electron producing mesh or grid electrode is located between this pair of reflector electrodes. Preferably the electron producing electrode is located substantially mid-way between and substantially parallel with the pair of reflector electrodes.

Preferably one of the reflector electrodes includes a plurality of apertures for the electrode to be permeable to a substantial number of the produced electrons, and the detector is located to detect produced electrons that pass through this electrode. Preferably this reflector electrode is a relatively fine metal mesh or grid.

In a further embodiment of the aspect of the invention in the immediately preceding paragraph, the other of the reflector electrodes preferably includes a plurality of apertures through which some of the oscillating ions can pass, and the spectrometer includes electronic means for lowering an electrical potential of this other reflector electrode for extracting through it oscillating ions of a selected mass that have become separated from oscillating ions of different mass due to their different oscillation frequencies. Preferably this electronic means is operative to apply a relatively high negative voltage pulse to the other reflector electrode. Preferably the other reflector electrode is also a relatively fine metal mesh or grid.

In operation, the reflector electrodes and electron emitting electrode are independently charged to a potential whereby the electron emitting electrode is at a lower (more negative) potential relative to the reflector electrodes. In one example the reflector electrodes are at about 0 volts and the electron emitting electrode is charged to a relatively high negative voltage, for example −4000 volts. This voltage regime has the effect of accelerating the produced electrons through the mesh or grid of said one reflector electrode and thus into the detector. The electronic means for lowering an electrical potential of one of the reflector electrodes to extract ions, pulses that electrode (the said other reflector electrode) to a relatively high negative potential for a relatively short period of time. In one embodiment this negative potential is approximately−4000 volts.

Preferably the detector is a channeltron detector.

Preferably the spectrometer includes means for introducing molecules into the spectrometer for ionization by the ionizing means in the form of a nozzle type sample injector or a pulsed nozzle type sample injector. Preferably such injector is designed to inject the molecules between one of the pair of reflector electrodes and the electron emitting electrode.

Preferably the ionization means is a pulsed laser which ionizes the molecules by multiphoton ionization (MPI).

For a better understanding of the invention and to show how it may be carried into effect, a preferred embodiment thereof will now be described, by way of non-limiting example only, with reference to the accompanying drawings.

DETAILED DESCRIPTION

Figure 1:
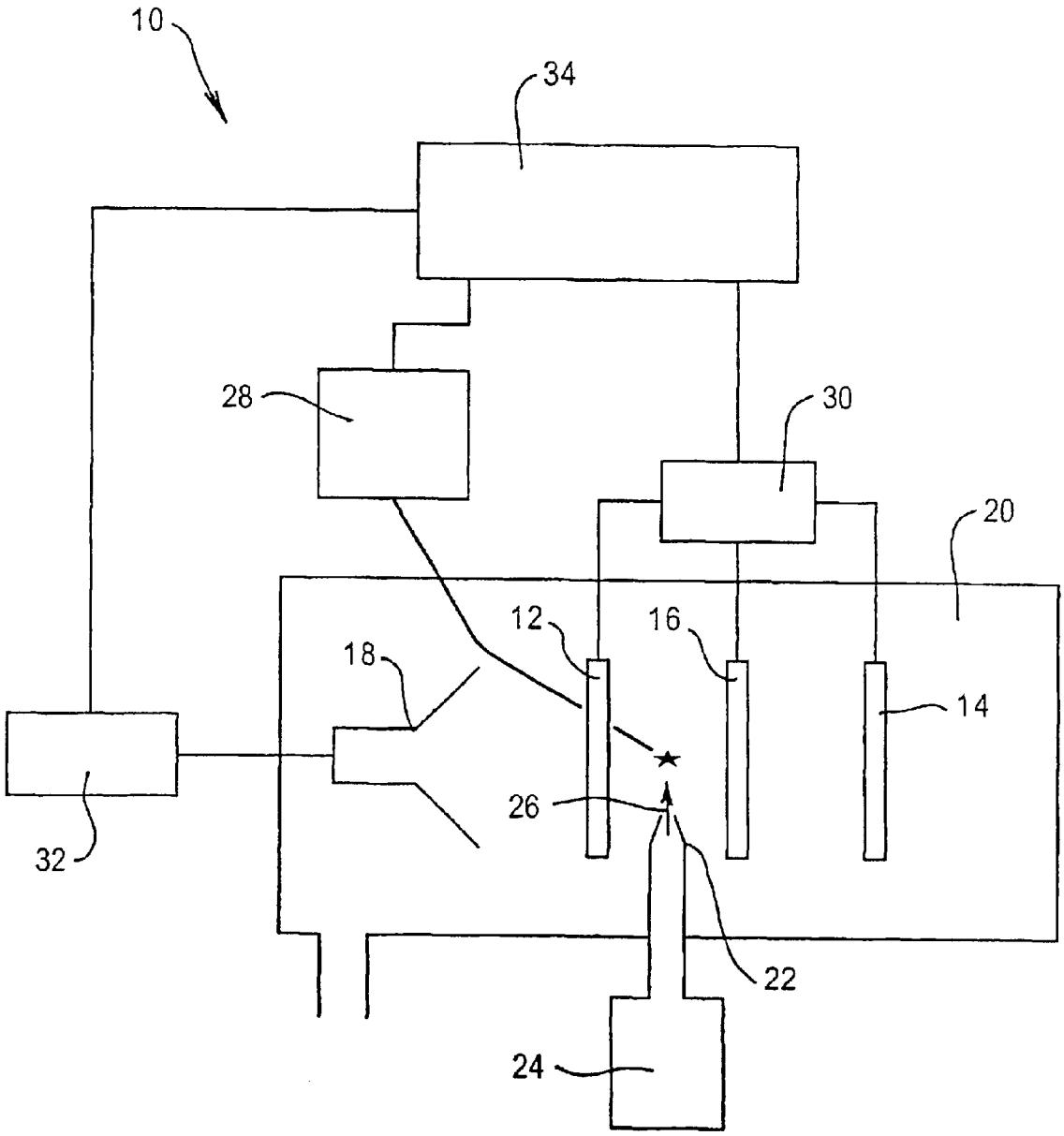
FIG. 1 is a schematic diagram of a mass spectrometer according to an embodiment of the invention.

A mass spectrometer 10 (see FIG. 1) according to an embodiment of the invention comprises a pair of generally parallel spaced apart reflector electrodes 12, 14, midway between which is located an electron producing means in the form of an electron emitting electrode 16 that is parallel to reflector electrodes 12, 14. A detector in the form of a channeltron ion detector 18 is located behind the electrode 12. The three electrodes 12, 14, 16 and detector 18 are located within a vacuum chamber 20. The spectrometer 10 also includes a sample injector 22 in the form of a pulsed valve or nozzle to which sample molecules are fed from a sample source 24 as is known in the art. The path of the sample molecules is represented by an arrow 26 in FIG. 1. The spectrometer 10 furthermore includes means for ionizing the molecules in the form of a pulsed laser 28, which ionizes the molecules as they are introduced between the reflector electrode 12 and the electron emitting electrode 16 via the pulsed sample injector 22. The pulsed laser 28 provides an intense and focussed laser beam which intersects the beam of molecules at the point represented by a star in FIG. 1 and ionizes the molecules by multiphoton ionization (MPI).

The electrodes 12, 14 constitute means for influencing the ions to cause them to oscillate to and fro. These electrodes 12, 14 and the electron producing electrode 16 are metal discs of a relatively fine mesh or grid construction which is sized to permit ions and electrons to permeate or pass through them. Typically, the ions and electrons pass through the mesh or grid electrodes 12, 14, 16 with about 85% efficiency. The spectrometer 10 includes voltage source means 30 whereby the electrodes 12, 14, 16 can independently be charged to a pre-determined potential such as a high positive or negative voltage whereby the ions are influenced by the electric field so produced to oscillate between the reflector electrodes 12 and 14. That is, the reflector electrodes 12 and 14 provide electric fields to reflect the ions to and fro therebetween assisted by the potential on electrode 16 to attract the ions.

Other components of the spectrometer 10 are an electronic signal amplification and digitisation means 32 connected to the detector 18 and a computer 34 for controlling and synchronising the operation of the spectrometer 10, and for processing the detected signals and providing an appropriate mass analysis output.

Figure 2A:
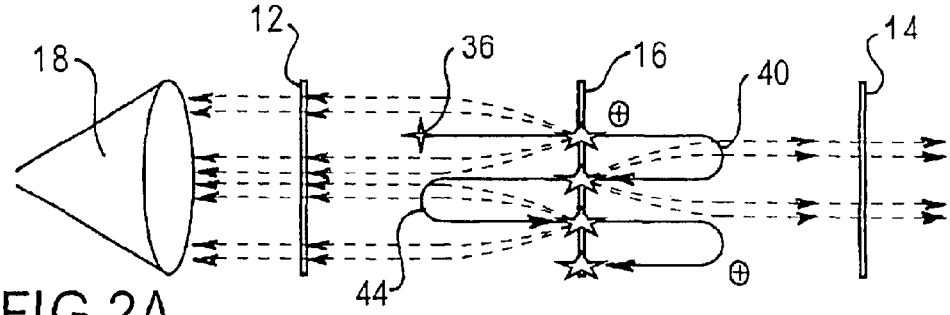
FIG. 2A is a schematic representation of ion trajectories in a mass spectrometer as in FIG. 1.
Figure 2B:
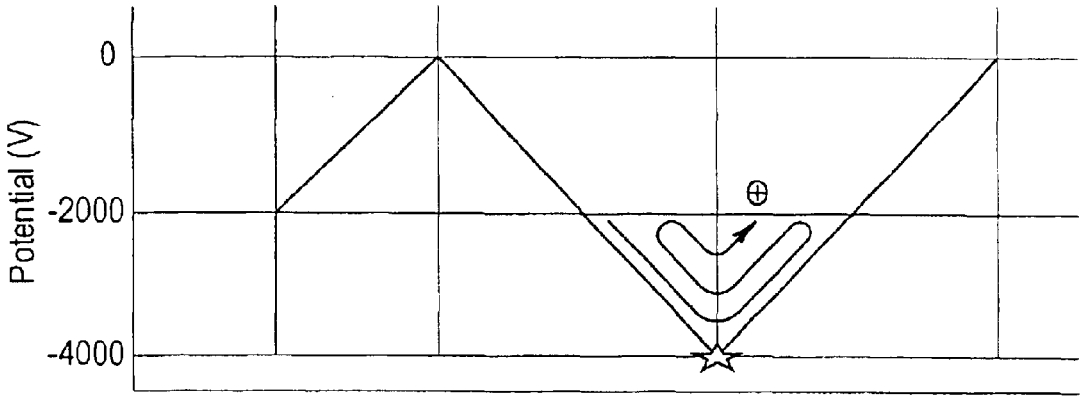
FIG. 2B is a graphical representation of the ion trajectories of FIG. 2A.
Figure 2C:
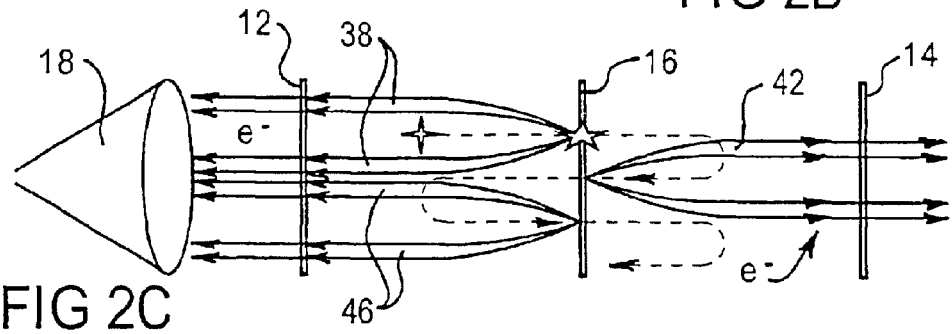
FIG. 2C is a schematic representation of electron trajectories in a mass spectrometer as in FIG. 1.
Figure 2D:
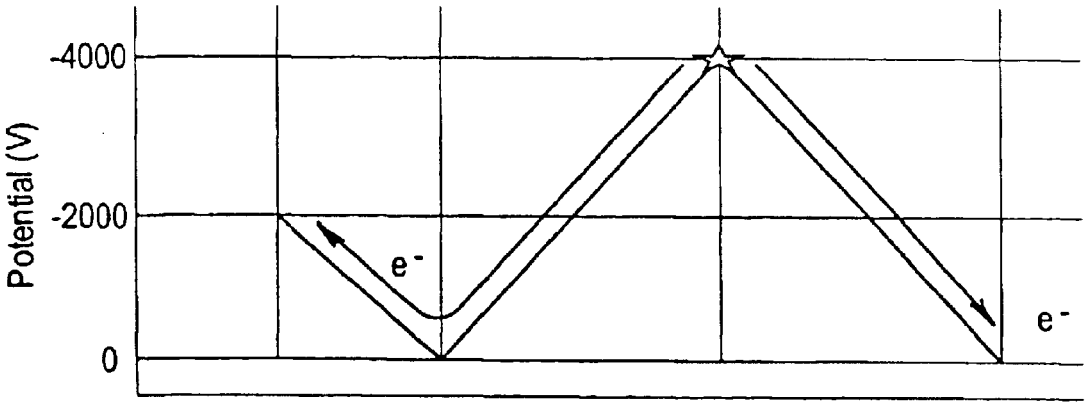
FIG. 2D is a graphical representation of the electron trajectories of FIG. 2C.

Operation of the spectrometer 10 is illustrated by FIGS. 2A to 2D. FIG. 2A represents the trajectories of the positive ions and FIG. 2C represents the trajectories of electrons. The plots of FIGS. 2B and 2D each show the one dimension electric potentials drawn to show that the ions or electrons travel "downhill" (that is, positive ions travel towards a negative potential, and electrons travel towards a less negative potential). Any positive ion or electron striking the channeltron detector 18 will produce an amplified current signal to be processed via electronic means 32 and computer 34. The sample Injector 22 is effective for introducing volatile components in the gas phase to the region between the reflector electrode 12 and the electron emitting electrode 16. The pulsed laser 28 ionizes the molecules by MPI at the point represented by the four pointed star 36 in FIG. 2A. The laser pulse in this example is very short, typically 5 ns. Photoelectrons are then produced and are accelerated from the laser focal point to the reflector electrode 12. If the photoelectrons receive more than 2 keV kinetic energy they will reach the detector 18. Otherwise the photoelectrons slow, stop and reverse direction eventually impacting the electrodes 12, 14 or 16 or the vacuum chamber 20 walls. The arrival of the photoelectrons at the detector 18 is almost instantaneous and acts as an internal clock for the spectrometer 10.

Positive ions are accelerated towards the electron emitting electrode 16 (which is at a potential of −4000 volts) and, if any of the ions collide with or strike the mesh or grid of this electrode 16, electrons are produced by secondary emission. These secondary emission electrons form the basis for the detection of the ions in the spectrometer 10. In this example about 15% of the ions impact with a wire in the mesh or grid of electrode 16. The kinetic energy of the ion impact exceeds the work function of the metal of the electrode 16 so that one or more secondary electrons are ejected. These electrons are accelerated towards and through the reflector electrode 12 mesh or grid (which is at 0 volts, that is, positive relative to the electrons) and are detected by the channeltron detector 18 (see reference 38 in FIG. 2C). The acceleration of the electrons increases their kinetic energy and thus improves the sensitivity of the spectrometer 10.

The positive ions that proceed through the electrode 16 mesh or grid (hereinafter the term "grid" is used to mean both a mesh or a grid) are slowed down by the increasingly positive potential between electrodes 16 and 14, and reversed back towards electrode 16 (see reference 40 in FIG. 2A). Once again about 15% of the ions impact the wires in the electrode 16 grid causing further electron emissions. These further secondary electrons are mostly accelerated towards the reflector electrode 14 (see reference 42 In FIG. 2C) and hence not detected. However it is considered that a second detector could be added behind the reflector electrode 14 grid to improve sensitivity.

The ions penetrating the electrode 16 grid are again reversed by the increasingly positive field between the electrodes 16 and 12 (see reference 44 in FIG. 2A) with another about 15% impacting the electrode 16 grid and causing another detectable electron peak (see reference 46 in FIG. 2C) at the channeltron detector 18. This oscillation of the ions and emission of electrons from the electrode 16 grid continues whilst ions remain in the spectrometer 10. The ions oscillate between the electrodes 12/16 and 16/14 midpoints with a frequency that depends on their mass. It is understood that all masses turn around at the same point, in this embodiment the midpoints between the electrodes 12/16 and 16/14.

Figure 3:
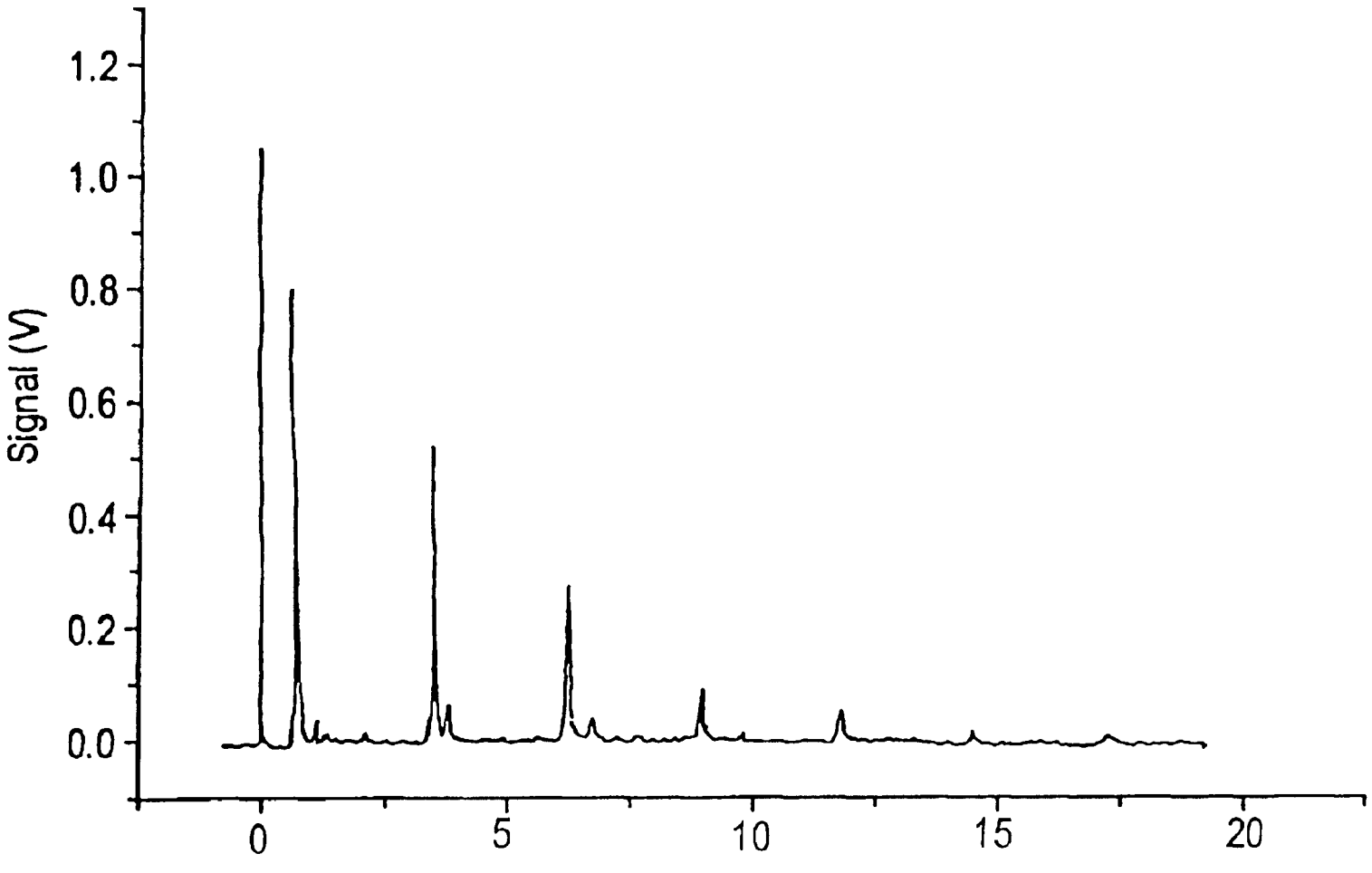
FIG. 3 is a mass spectrum of p-difluorobenzene (pDFB) of the mass spectrometer of FIG. 1
Figure 4:
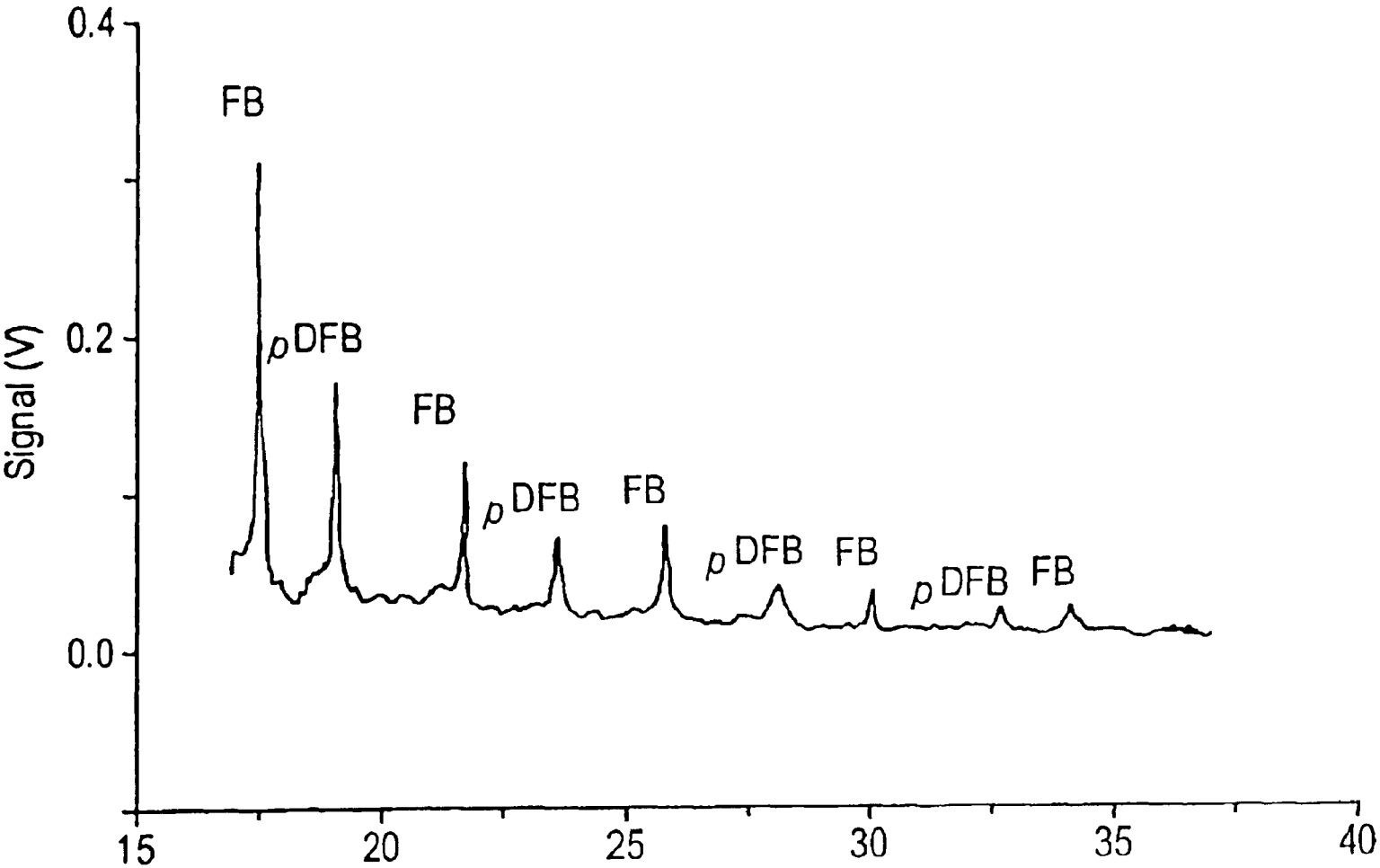
FIG. 4 is a mass spectrum of pDFB and fluorobenzene (FB) of the mass spectrometer of FIG. 1.

FIG. 3 shows an oscillating mass spectrum of p-difluorbenzene (pDFB, mass=114 amu). The first peak is the photoelectron peak which occurs at t=0. The subsequent peaks are all equally spaced and all correspond to pDFB striking the central electron emitting electrode 16 from left to right in FIG. 2A. FIG. 4 shows an oscillating mass spectrum for a sample containing two different species, namely pDFB and fluorobenzene (FB, mass=96 amu). The oscillating ion signal can be seen clearly. It can also be observed that there is an increasing separation between the masses as they continue to oscillate through the spectrometer 10, as expected given their different oscillation frequencies. The first peak in the spectrum in this figure is the ninth oscillation of FB.

Figure 5:
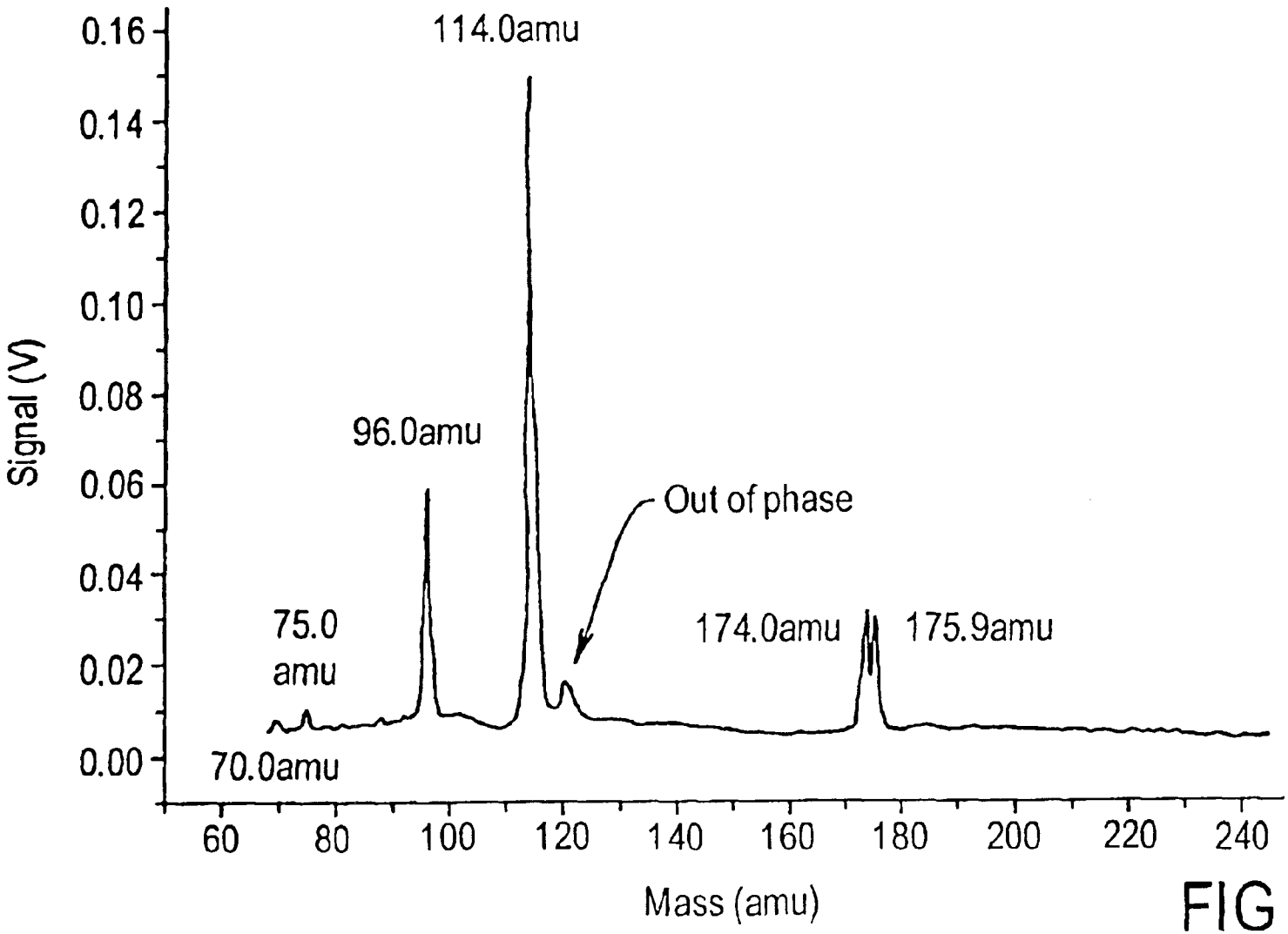
FIG. 5 is a mass spectrum of pDFB, FB and bromofluorobenzene (BFB) of the mass spectrometer of FIG. 1.

The spectrum in FIG. 5 shows a mixture of three species, FB, pDFB and bromofluorbenzene (BFB). Bromine atoms have two naturally occurring isotopes, m=79 and 81 with almost equal abundance. The two corresponding BFB masses, 174 and 175.9 amu are also seen clearly resolved. This spectrum shows only the seventh pass of the ions with earlier and later passes omitted for clarity. However, it should be appreciated that this whole pattern itself oscillates In the full spectrum. At higher passes and with more careful laser focussing it is possible to observe the naturally occurring D-isotopic species near all major peaks (which is separated by 1 amu from the totally protonated molecule).

Figure 6A:
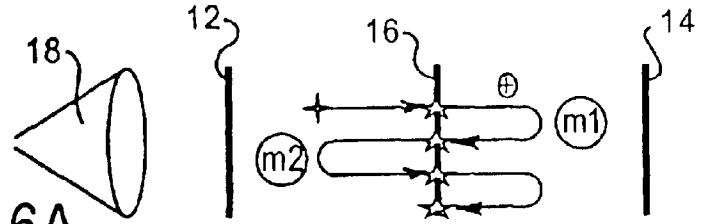
FIGS. 6A to 6F are schematic and graphical representations of ion and electron trajectories, similar to FIGS. 2A to 2D, but illustrating pulsing of an electrode to extract selected ions from the spectrometer.
Figure 6B:
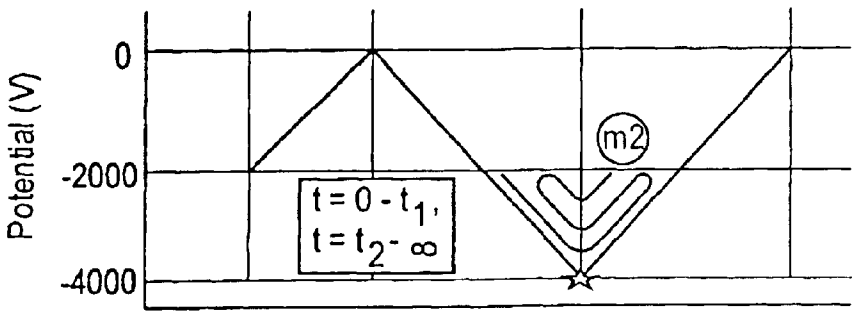
Figure 6C:
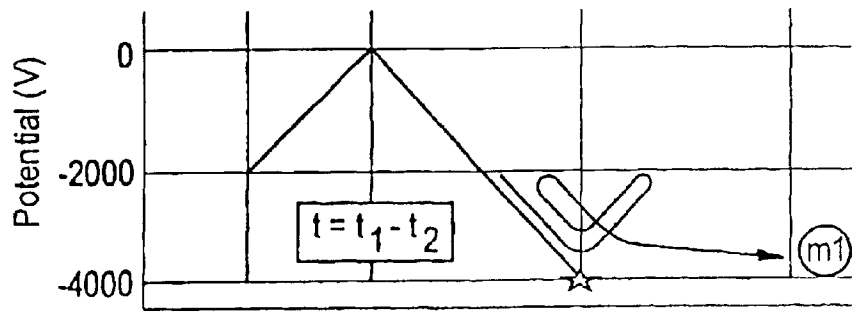
Figure 6D:
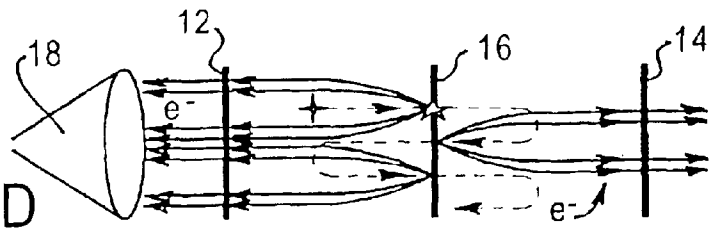
Figure 6E:
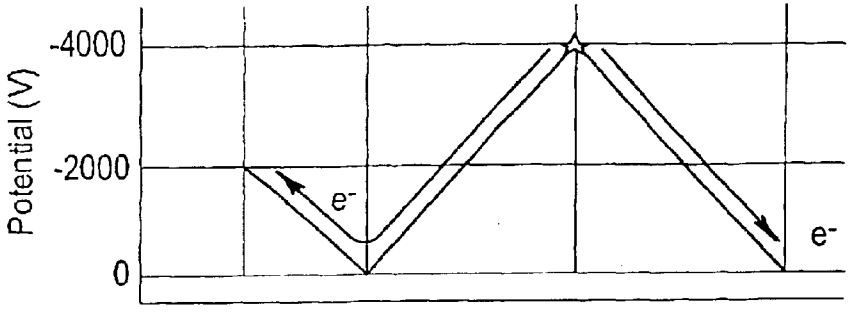
Figure 6F:
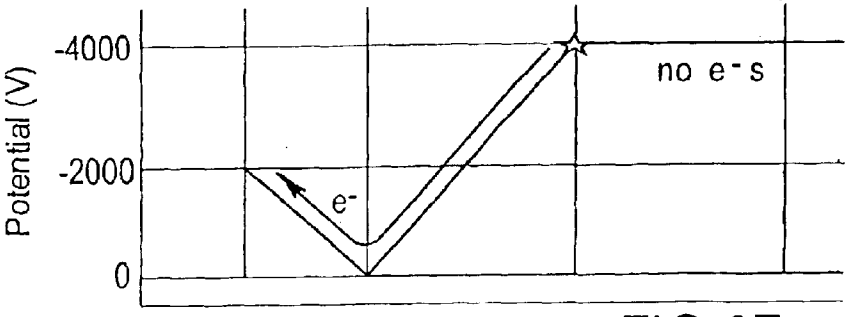
Figure 7:
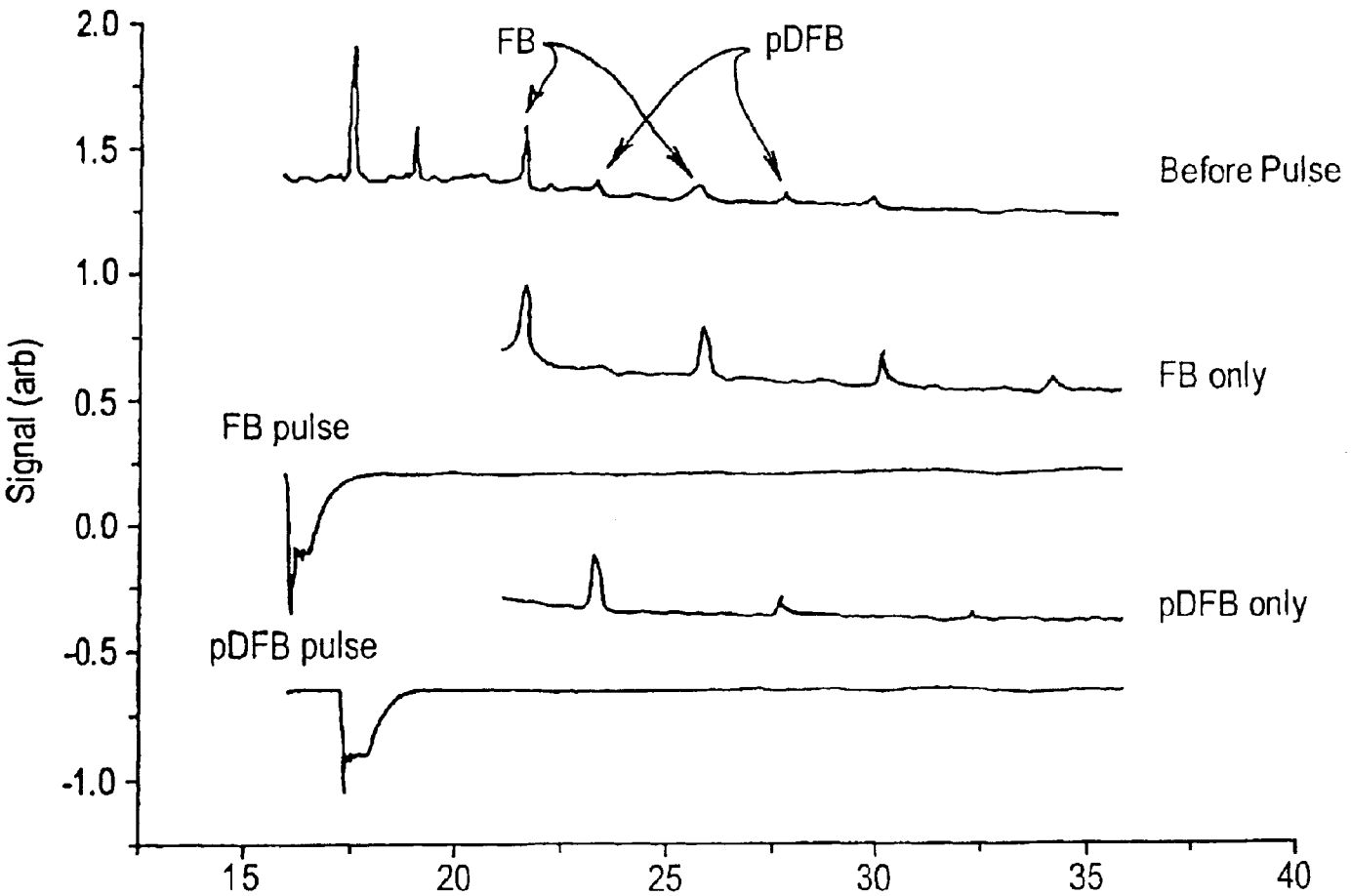
FIG. 7 is a mass spectrum of pDFB and FB of the mass spectrometer when pulsed in accordance with FIG. 6.

After a predetermined number of oscillations in the spectrometer 10, species of different mass will be half an oscillation out-of-phase. At this time, mass (m1) and mass (m2) will find themselves in the opposite halves of the spectrometer 10 (see FIG. 6A). If the reflector electrode 14 grid is then pulsed quickly to a high negative potential the positive ions m1 in that half of the spectrometer 10 will be extracted, see FIG. 6C. If the reflector electrode 14 grid can then be returned to ground potential (that is, 0 volts) before the other ions m2 enter that stage of the spectrometer 10, then ions m2 will continue to oscillate as if nothing had happened. FIG. 7 demonstrates an example of this operation. The total spectrum at the top of the figure starts at the ninth pass of FB and pDFB through the central electrode 16, at which stage they are approximately half an oscillation out of phase.

The extraction pulse is timed to occur when either FB or pDFB is between electrodes 16 and 14. The other two spectra of FIG. 7 demonstrate that one or the other species can be eliminated without the other affected. Thus by means of computer 34 controlling voltage source means 30, it is possible to send a high voltage pulse train to the reflector electrode 14 grid to eliminate most species from a complex "soup" of chemicals. This simplifies the mass spectrum and is selective in the species of interest for further study.

The applicant has also conducted extensive three-dimensional theoretical modelling electrical fields in the spectrometer 10 and run ion trajectories through these fields. The applicant has confirmed through this modelling that the ions behave as described above.

Those skilled in the art will appreciate that the invention as described herein is susceptible to variations and modifications other than those specifically described. For example, the channeltron detector 18 may be replaced with a multichannel plate (MCP) which is more sensitive and smaller than the channeltron detector 18. Thus, the MCP will result in an even smaller overall design of the mass spectrometer 10 which is a significant advantage in the design of the spectrometer. Additionally, direct one photon vacuum ultraviolet (VUV) ionization may be used instead of the laser ionization 28 as described. VUV light is understood to ionise almost any molecule with a large efficiency. The pulsed nozzle 22 described is also only one of many injection devices, such as a continuous source or electrospray source, which may be used for the described invention. It is also to be understood that the reflector electrodes 12 and 14 and/or the electron emitting electrode 16 grids may be of different permeabilities to that described, for example 95% throughput will reduce the secondary electrons emitted and thus the signal on each pass of the ions but will allow many more passes to occur and hence better mass resolutions. All such variations and modifications and others to which the invention is susceptible are to be considered within the scope of the present invention according to the scope of the following claims.

What is claimed is:

1. A mass spectrometer for measuring the mass of molecules comprising:

ionization means for producing ions of the molecules;

means for influencing said ions to cause them to oscillate to and fro, whereby the frequency of oscillation of an ion depends upon its mass;

an electron producing means disposed in relation to the oscillating ions for some of the oscillating ions to cause the electron producing means to produce electrons at a frequency determined by an oscillation frequency of the ions; and a detector for detecting the electrons and frequency of production thereof from which the mass of ions oscillating at that frequency is calculable.

2. The mass spectrometer of claim 1, wherein the electron producing means is such that it emits electrons upon collision of an oscillating ion therewith.

3. The mass spectrometer of claim 2, wherein the electron producing means is an electrode that comprises a plurality of apertures through which some of the oscillating ions can pass while others of the oscillating ions collide with the electrode.

4. The mass spectrometer of claim 3, wherein the electrode is a relatively fine metal mesh or grid.

5. The mass spectrometer of claim 1, wherein the means for influencing said ions are electrodes for providing electric fields for reflecting the ions to cause them to oscillate to and fro.

6. The mass spectrometer of claim 5, wherein the electrodes are a pair of spaced apart generally parallel electrodes, and wherein the electron producing means is a further electrode located between the pair of electrodes, the further electrode including a plurality of apertures through which some of the oscillating ions can pass while others of the oscillating ions collide with the further electrode for that electrode to emit electrons.

7. The mass spectrometer of claim 6, wherein the further electrode is located substantially mid-way between and substantially parallel with said pair of electrodes; and wherein at least one of said pair of spaced apart generally parallel electrodes includes a plurality of apertures through which some of the oscillating ions can pass.

8. The mass spectrometer of claim 6, further comprising electronic means for lowering an electrical potential of the at least one electrode for extracting through the at least one electrode oscillating ions of a selected mass that have become separated from oscillating ions of different mass due to their different oscillation frequency.

9. The mass spectrometer of claim 8, wherein the electronic means is operative to apply a relatively high negative voltage pulse to the at least one electrode.

10. The mass spectrometer of claim 9, wherein the at least one electrode is a relatively fine metal mesh or grid.

11. The mass spectrometer of claim 6, wherein at least one of said pair of spaced generally parallel electrodes comprises a plurality of apertures whereby the electrode is permeable to a substantial number of the produced electrons, and the detector is located to detect produced electrons that pass through the at least one electrode.

12. The mass spectrometer of claim 11, wherein the at least one electrode is a relatively fine metal mesh or grid.

13. The mass spectrometer of claim 1, wherein the detector is a channeltron detector.

14. The mass spectrometer of claim 1, comprising means for introducing molecules into the spectrometer for ionization by the ionizing means.

15. The mass spectrometer of claim 14, wherein the means for introducing the molecules is a nozzle type sample injector.

16. The mass spectrometer of claim 15, wherein the mean for introducing the molecules is a pulsed nozzle type sample injector.

17. The mass spectrometer as claimed in claim 14, wherein the ionization means is a pulsed laser.

18. A method for mass spectrometry comprising the steps of:

a) ionizing molecules of a sample to produce ions thereof;

b) influencing the ions to cause them to oscillate to and fro, whereby the frequency of oscillation of an ion depends upon its mass;

c) causing some of the oscillating ions to interact with an electron producing means, whereby electrons are produced at a frequency determined by an oscillation frequency of the ions;

d) detecting the produced electrons and frequency of production thereof; and e) from the frequency determination of step (d), calculating the mass of ions oscillating at that frequency.

19. The method of claim 18, wherein step (b) comprises establishing electric fields for reflecting the ions to cause them to oscillate to and fro; and wherein step (c) involves causing some of the oscillating ions to collide with the electron producing means for that means to emit electrons.

20. The method of claims 19, further comprising an additional step of extracting oscillating ions of a selected mass that have become separated from oscillating ions of different mass due to their different oscillation frequency; said extracting step involves temporarily modifying the electric field such that ions of the selected mass are not reflected and pass through the field.

* * * * *